United States Patent [19]

Bonney

[11] 4,184,513

[45] Jan. 22, 1980

[54] MULTIPLE THREE AND/OR TWO WAY VALVE

[76] Inventor: Roland W. Bonney, R.F.D. 1 Box 65, Kennebunkport, Me. 04046

[21] Appl. No.: 7,910

[22] Filed: Jan. 31, 1979

[51] Int. Cl.[2] ..... F15B 13/06

[52] U.S. Cl. ..... 137/596.12; 137/596.2; 137/636.4; 137/DIG. 2

[58] Field of Search ..... 137/DIG. 2, 596.12, 137/596.2, 636.4

[56] References Cited

U.S. PATENT DOCUMENTS

| | | | |
|---|---|---|---|
| 2,392,421 | 1/1946 | Stephens | 137/596.12 |
| 3,774,504 | 11/1973 | Bonney | 137/596.2 X |
| 4,027,697 | 6/1977 | Bonney | 137/596.2 X |

FOREIGN PATENT DOCUMENTS

| | | | |
|---|---|---|---|
| 180482 | 8/1962 | Sweden | 137/596.12 |

*Primary Examiner*—Gerald A. Michalsky
*Attorney, Agent, or Firm*—William Nitkin

[57] ABSTRACT

A multiple three and/or two way valve comprising a valve housing having a cylindrical bore defined therein with an inlet port and an outlet port. In one embodiment the valve can have at least one two-way pressure-on, pressure-off outlet and/or a series of pressurizing ports defined in the valve housing communicating into the cylindrical bore. A spool member axially slidable and rotatable is located within the cylindrical bore. The spool member has a blocking ring member extending therearound, a shoulder, and a feed slot. The spool is adapted to be rotated to align the feed slot to either the two-way pressure-on, pressure-off outlet or one of the series of pressurizing ports which are defined in the valve housing radially in a transverse plane to the axis of, and communicating into, the cylindrical bore. Also defined within the valve housing is a plurality of relief ports also disposed in a plane transverse to the axis of, and communicating into, the cylindrical bore. The valve is operated by the movement axially and rotationally of the spool member.

8 Claims, 4 Drawing Figures

MULTIPLE THREE AND/OR TWO WAY VALVE

BACKGROUND OF THE INVENTION

1. Field of the Invention

This invention relates to valves and more particularly to multiple three and/or two way valves utilized in hydraulic control systems.

2. Description of the Prior Art

Spool valves for utilization with hydraulic control systems are well-known in the prior art. The inventor of the present invention has received three prior U.S. patents in this area, namely U.S. Pat. No. 3,774,504 for a Sliding Spool Valve; U.S. Pat. No. 4,027,697 for a Rotary Valve; and U.S. Pat. No. 4,124,038 for a Multi-way Hydraulic Valve. These patents and the references cited therein are related to the field in which the present invention resides.

SUMMARY

The present invention is a multiple three and/or two way valve incorporated in a single valve housing. The valve of this invention can be a three way valve if utilized through one series of ports therein and/or a two way valve if utilized through another port or series of ports, or a combination of the two. It also can be constructed in either a two way or three way mode.

It is an object of this invention to provide a relatively small valve having a good flow rate.

It is a further object of this invention to provide a valve where the flow rate remains constant regardless of the number of ports incorporated into the unit.

It is yet a further object of this invention to eliminate the need for cylinder-locking or load-holding valves which are otherwise utilized in the prior art.

The valve of this invention can be utilized manually or by other conventional control means and needs only one control member. The three way valve of this invention is particularly useful for operations of single-acting cylinders where pressure lifts or extends the cylinder's piston's rod and gravity, a spring member, or other means causes its return to rest when the pressure is relieved. The two way valve incorporated herein is useful for the operation of a single direction of rotation motors or any other "pressure-on, pressure-off" application. The valve can be adapted for two way operation only by the blocking, elimination of certain channels therein.

It is still a further object of this invention that the operation of any one of the valve ports will have no effect on any of the other port operations.

The present invention is comprised of a valve housing having defined therein a cylindrical bore. An inlet port is also defined in the valve housing which communicates into the cylindrical bore and is adapted to allow the entrance of hydraulic fluids into the cylindrical bore. Also defined in the valve housing is a tank outlet port which communicates into the cylindrical bore and is adapted to allow the escape of hydraulic fluid from the cylindrical bore usually to the tank or other equivalent areas of escape within hydraulic systems. In one embodiment of the valve, it can have at least one or, if desired, more two way pressure-on, pressure-off outlets defined in the valve housing each communicating into the cylindrical bore. Within the cylindrical bore is located a spool member which is adapted to be axially slidable and rotatable therein. Extending around the spool member and projecting therefrom is a blocking ring. There are means defined within the valve housing to form a blocking ring member seal which is adapted so that when the blocking ring member is axially moved contacting a portion of the valve housing, such seal is formed which prevents the escape of hydraulic fluid that enters from the inlet port out to the tank outlet port. Further defined within the spool member is a feed slot which is adapted so that when aligned with a pressure-on, pressure-off two way outlet, the blocking ring is sealed in a fluid-tight relation against the sides of the cylindrical bore in the valve housing so that the hydraulic fluid will pass from the inlet port through the feed slot and out the pressure-on, pressure-off two way outlet. If the spool is moved axially or rotated so that the feed slot is no longer aligned with the pressure-on, pressure-off two way outlet, further exit of fluids through the pressure-on, pressure-off outlet is prevented as it is blocked by the body of the spool. In a further embodiment, a plurality of relief ports can be defined in the valve housing, being disposed in a plane transverse to the axis of, and communicating into, the cylindrical bore. Each of the relief ports can have check means associated therewith, the check means being normally biased closed but adapted to be opened with a portion of the check means extending into the cylindrical bore. A shoulder can be defined on the spool member adjacent to the blocking ring member adapted so that if the spool is rotated and moved toward a particular relief port opening means, it will raise the opening means out of the cylindrical bore thereby allowing the entry of fluids through the relief ports. Further, a series of pressurizing ports can be defined in the valve housing disposed radially in a plane transverse to the axis of, and communicatng into, the cylindrical bore located on the other side of the spool blocking ring member as the relief ports. Associated with each of the pressurizing ports are check means which are normally biased closed but adapted to be opened and which are operated when the spool member is moved so that its blocking ring member makes fluidtight contact with the valve housing preventing the flow of hydraulic fluid from the inlet port to the tank outlet and the feed slot is rotated in alignment with a selected pressurizing port thereby allowing the hydraulic fluid within the cylindrical bore to escape through the pressurizing port as the fluid's pressure, once it can no longer escape to tank, rises and is then sufficient to open the pressurizing port check means thereby allowing the passage of hydraulic fluid through the selected pressurizing port. A channel can connect each selected pressurizing port to an associated relief port. An operation outlet port communicates with each of the pressurizing ports and is adapted for interconnection to the device to be operated by the valve of this invention. Opposite the feed slot on the spool can be a corresponding balance slot which operates in association with one or more pressurizing port balance apertures defined within the valve housing, each opposite a respective pressurizing port for the balancing of pressures within the system. Also defined within the valve housing is a relief chamber area within which area the blocking ring's spool projection is moved axially and which allows additional room for the easier passage of fluid from the inlet port to the tank outlet port. In all embodiments sealing means can be positioned toward each end of the spool member to seal the spool member within the cylindrical bore in a fluid-tight relation and stop means can be provided to limit the axial movement of the spool member.

The objects and design of the instant invention will become clearer with reference to the following drawings and Description of the Preferred Embodiment below.

DESCRIPTION OF THE PREFERRED EMBODIMENT

Figure 1:
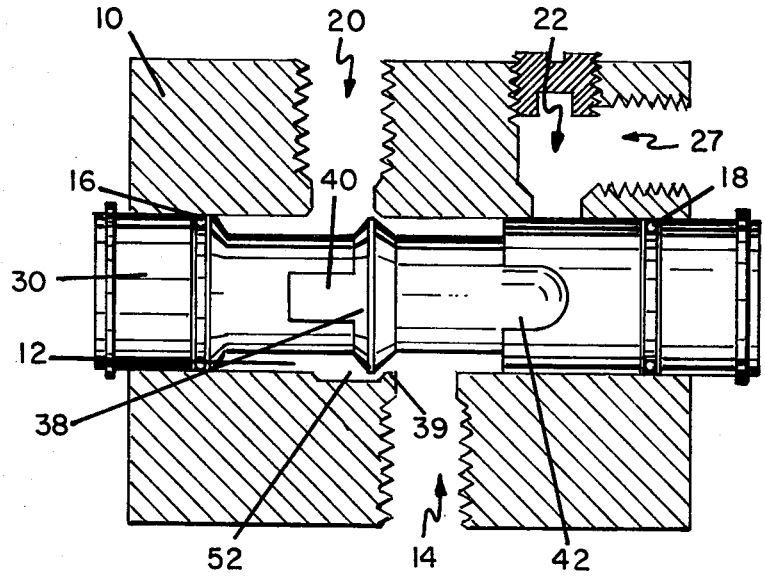
FIG. 1 discloses a horizontal cross-section through the valve housing with the spool in place being shown as a completed structure and not in half-section.
Figure 2:
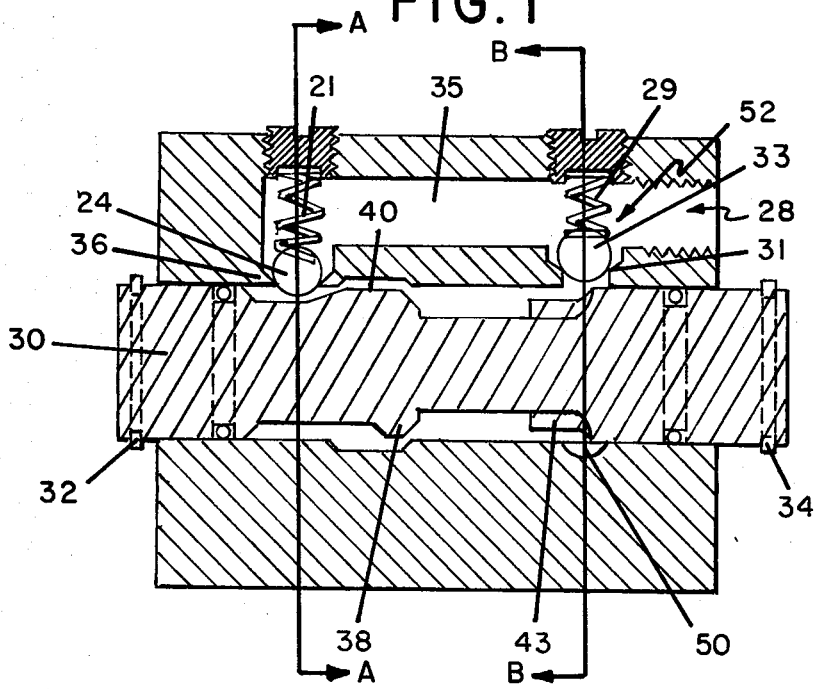
FIG. 2 illustrates a cross-sectional view vertically through the device of this invention.
Figure 3:
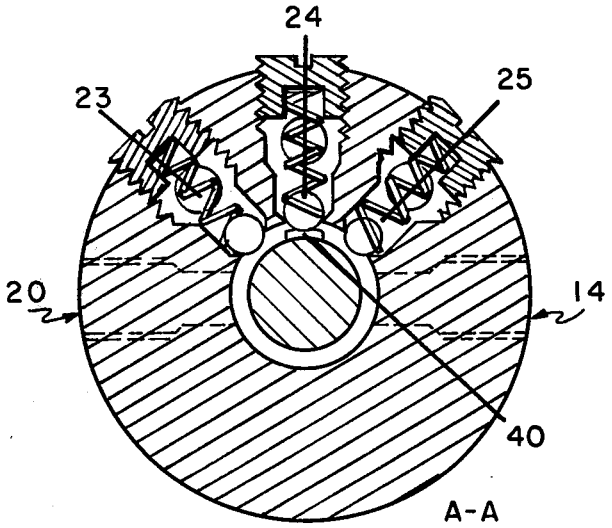
FIG. 3 illustrates a cross-sectional view through section A—A of FIG. 2.
Figure 4:
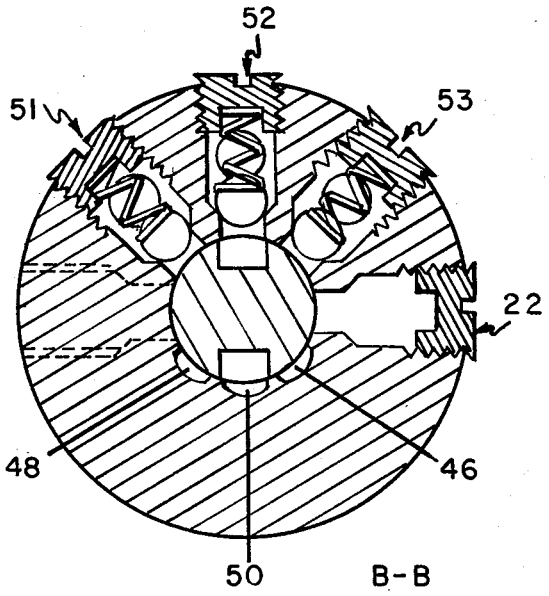
FIG. 4 illustrates a cross-sectional view through section B—B of FIG. 2.

FIG. 1 illustrates the device of this invention having a valve housing 10 with a cylindrical bore 12 defined therein. Valve housing 10 also contains inlet port 14 and tank outlet port 20, both of which enter into cylindrical bore 12. A series of relief ports 23, 24, and 25 as seen in FIGS. 2 and 3 are defined in valve housing 10 extending radially in a transverse plane around and each communicating into cylindrical bore 12. Each relief port has associated therewith a check member or equivalent such as the ball check member seen in relief port 24 in FIGS. 2 and 3. Each of the relief ports constricts at its entrance into cylindrical bore 12 forming a seat such as seat 36 seen in FIG. 2 in which the poppet (ball) of the check valve can fit in a fluid-tight relation. A check valve spring member or equivalent such as element 21 in FIG. 2 is adapted within each relief port to urge against the check poppet illustrated herein as ball check forcing it against its associated seat thereby closing the relief port into cylindrical bore 12. Each relief port and its seat are adapted so that each of the check members when seated has a face thereof protruding into cylindrical bore 12. A series of pressurizing ports 51, 52 and 53, seen in FIG. 4, are also defined in valve housing 10 extending radially in a transverse plane around and each communicating into cylindrical bore 12. Each pressurizing port contains a holding check such as illustrated within pressurizing port 52 in FIG. 2. The holding check such as element 29 in FIG. 2 includes a holding check seat 31 defined with valve housing 10 and has a hold check spring urging a holding check ball 33 against holding check seat 31 with a predetermined pressure which will be discussed below. Each pressurizing port communicates with a corresponding relief port through a channel such as 35 in FIG. 2. For example, pressurizing port 52 communicates with relief port 24, pressurizing port 53 with relief port 25 and pressurizing port 51 with relief port 23. The channels each communicate with an operation port outlet in valve housing 10 such as 28 in FIG. 2 which are adapted to being interconnected by hose or other communication members to the apparatus to be operated by the valve.

Defined in valve housing 10 can be at least one off-on control port 22 which communicates into cylindrical bore 12 and to off-on outlet 27 in FIG. 1 which is adapted for interconnection to an apparatus such as a motor working on a two way valve, i.e., "pressure-on, pressure-off" principle. Within the cylindrical bore is positioned a spool 30 having stop members 32 and 34 defined at the ends thereof to limit its axial movement therein, the spool being adapted to be rotated and axially moved within the cylindrical bore. Further defined along the spool are a first sealing means 16 and second sealing means 18. Such sealing means can be comprised of sealing rings within grooves or any other equivalent means to create a fluid-tight relation between the outer portions of the spool and the cylindrical bore. Between the sealing means are defined along the spool a blocking ring spool projection 38 having a shoulder 40 extending therefrom toward said first sealing means 16 which is adapted to, when axially moved to a position below a selected relief port ball check, raise said ball check thereby opening its associated relief port into the cylindrical bore 12. Defined on the spool on the other side of the blocking ring spool projection 38 from said shoulder 40 is a narrower portion of the spool which extends for a distance and then the spool returns to the full diameter of the cylindrical bore before reaching the second sealing means. Defined within the section of full width is feed slot 42. Opposite feed slot 42 on the spool is balance slot 43 whose function will be described below. Within the valve housing is defined within the cylindrical bore a widened section around spool 30 being relief chamber 52.

In practice when the spool is in its neutral, non-activating central position the hydraulic fluid circulating in the system enters through inlet port 14, passes through the cylindrical bore 12 and escapes through the tank outlet 20 by passing around spool projection 38 through relief chamber 52. When the spool projection 38 is axially moved to the right toward second sealing means 18, the spool projection member 38 makes fluid-tight contact with sides 39 of the valve housing at the end of relief chamber 52 thereby blocking only further flow from inlet 14 through to tank outlet 20.

As the spool is rotated, feed slot 42 can align with each pressurizing port if it is rotated thereunder. All other pressurizing ports then are blocked by the body of the spool. The pressure of the fluid is now sufficiently high, since it cannot escape out the tank outlet 20, to raise the pressurizing port ball check by compressing its spring and cause the fluid to pass through the selected pressurizing port. The fluid then passes out the operation outlet operating the apparatus to which it is connected. When rotated so that the feed slot aligns with the on-off control port 22, this positioning will pressurize the apparatus interconnected to this port which operates on a "pressure-on, pressure-off" principle. There is no ball check illustrated in this port but can be, for example, to prevent reverse of the motor to stop back pressure. After pressurizing the on-off control port outlet, if one wishes to turn it off, one rotates or pushes the spool member away so that its feed slot moves away from the motor control outlet.

If one wishes to release the pressure at the operation outlet, one then moves the spool axially to the left, thereby covering the pressurizing port opening and raising the relief ball check of the associated relief port thereby allowing the hydraulic fluid to pass through the operation port, the channel, and the relief port through the cylindrical bore and to the tank through tank outlet 20. By operating the spool in various rotated positions, one can activate or deactivate any selected one of the series of pressurizing ports. If one wishes to operate the on-off port, one merely rotates the spool to the position of the on-off port 22 and moves it axially to the right.

Opposite the feed slot 42 is a balance slot 43. It has been found that since there is significant pressure within the system, there must be a balancing of pressures evenly around the spool otherwise it will be forced by the pressure against the sides of the valve housing preventing its easy movement. Therefore means are necessary to put opposing pressures to the pressure that might otherwise be on the spool in the vicinity of the feed slot which is accomplished by using a balancing slot and a series of pressurizing port balance apertures 46, 48, and 50 defined in the valve housing which are spot drilled opposed to each of the pressurizing ports so that when any pressurizing port is activated, there will not be created a pressure in the feed slot and against the spool forcing the spool against the opposite sides of the cylindrical bore of the valve housing. These pressure port balance apertures and balancing slot cause a balance of the hydraulic fluid on either side of the spool keeping pressures evenly around it thereby allowing it to be moved freely.

If one desires to utilize the valve only in its two way mode, that is "pressure-on, pressure-off" mode, the channels and relief port could be omitted in its construction and vice versa, if one wished a three way valve only, one could omit the two way on-off outlets. The spool can be urged to its neutral position by using spring members to center it when it is not moved into an active position as is common practice in spool valves.

Although the present invention has been described with reference to particular embodiments, it will be apparent to those skilled in the art that variations and modifications can be substituted therefor without departing from the principles and spirit of the invention.

I claim:

1. A valve comprising:

a valve housing;

a cylindrical bore defined in said valve housing;

an inlet port defined in said valve housing communicating into said cylindrical bore adapted to allow the entrance of hydraulic fluid into said cylindrical bore;

a tank outlet port defined in said valve housing communicating into said cylindrical bore adapted to allow the escape of hydraulic fluid from said cylindrical bore;

at least one pressure-on, pressure-off outlet defined in said valve housing communicating into said cylindrical bore;

a spool member axially slidable and rotatable within said cylindrical bore;

a blocking ring member extending around and projecting from said spool member;

seal means defined within said valve housing adapted when activated to prevent the escape of hydraulic fluid entering from said inlet port out said tank outlet port;

feed means defined within said spool adapted so that when aligned with said pressure-on, pressure-off outlet and said seal means are actuated, said fluid passes from said inlet port out said pressure-on, pressure-off outlet;

at least one relief port defined in said valve housing disposed in a plane transverse to the axis of, and communicating into, said cylindrical bore;

check means associated with said relief port, said check means being normally biased closed but adapted to be opened;

opening means adapted when activated to open said check means thereby allowing the entry of fluids through said relief port;

at least one pressurizing port defined in said valve housing disposed radially in a plane transverse to the axis of, and communicating into, said cylindrical bore;

pressurizing port check means associated with said pressurizing port being normally biased closed, but adapted to be opened, said pressurizing port adapted to be operated when said seal means is activated, and said feed means aligned with said pressurizing port thereby causing the hydraulic pressure within said cylindrical bore to escape through said pressurizing port;

a channel connecting said pressurizing port to said relief port; and an operating outlet port communicating with each of said pressurizing ports for connecting with a device to be operated by said valve.

2. A valve comprising:

a valve housing;

a cylindrical bore defined in said valve housing;

an inlet port defined in said valve housing communicating into said cylindrical bore adapted to allow the entrance of hydraulic fluid into said cylindrical bore;

a tank outlet port defined in said valve housing communicating into said cylindrical bore adapted to allow the escape of hydraulic fluid from said cylindrical bore;

at least one pressure-of, pressure-off outlet defined in said valve housing communicating into said cylindrical bore;

a spool member axially slidable and rotatable within said cylindrical bore;

a blocking ring member extending around and projecting from said spool member;

means defined within said valve housing forming a blocking ring member seal adapted so that when said blocking ring member is axially moved contacting said valve housing, it prevents the escape of hydraulic fluid entering from said inlet port out said tank outlet port;

a feed slot defined within said spool adapted so that when aligned with said pressure-on, pressure-off outlet, said blocking ring member is sealed in a fluid-tight relationship against said valve housing and said fluid passes from said inlet port through said feed slot to and out said pressure-on, pressure-off outlet, said spool being adapted to be moved if desired to a position having the feed slot unaligned from the pressure-on, pressure-off outlet thereby preventing further entry of fluid therethrough said pressure-on, pressure-off outlet then being blocked by said spool;

a plurality of relief ports defined in said valve housing disposed in a plane transverse to the axis of, and communicating into, said cylindrical bore;

check means associated with each of said relief ports, said check means being normally biased closed but adapted to be opened, each check means including opening means extending into said cylindrical bore;

a shoulder defined on said spool member adjacent to said blocking ring member adapted so that if said spool is moved toward said relief port opening means, it raises said opening means out of said cylindrical bore thereby allowing the entry of fluids therethrough;

a series of pressurizing ports defined in said valve housing disposed radially in a plane transverse to the axis of, and communicating into, said cylindrical bore;

pressurizing port check means associated with each of said pressurizing ports being normally biased closed, but adapted to be opened, said pressurizing ports adapted to be operated when said spool member is moved so that said blocking ring member is moved against said valve housing preventing the flow of hydraulic fluid from said inlet port to said tank outlet, and said feed slot is aligned with a selected pressurizing port thereby causing the hydraulic pressure within the cylindrical bore to escape through said pressurizing port as said fluid's pressure against said pressurizing port check means opens said pressurizing port check means allowing escape of said fluid through said pressurizing port;

a channel connecting each selected pressurizing port to an associated relief port; and an operation outlet port communicating with each of said pressurizing ports for connecting with a device to be operated by said valve.

3. A valve comprising:

a valve housing;

a cylindrical bore defined in said valve housing;

an inlet port defined in said valve housing communicating into said cylindrical bore adapted to allow the entrance of hydraulic fluid into said cylindrical bore;

a tank outlet port defined in said valve housing communicating into said cylindrical bore adapted to allow the escape of hydraulic fluid from said cylindrical bore;

a spool member axially slidable and rotatable within said cylindrical bore;

a blocking ring member extending around and projecting from said spool member;

means defined within said valve housing forming a blocking ring member seal adapted so that when said blocking ring member is axially moved contacting said valve housing, it prevents the escape of hydraulic fluid entering from said inlet port out said tank outlet port;

a feed slot defined in said spool;

a plurality of relief ports defined in said valve housing disposed in a plane transverse to the axis of, and communicating into, said cylindrical bore;

check means associated with each of said relief ports, said check means being normally biased closed but adapted to be opened, each check means including opening means extending into said cylindrical bore;

a shoulder defined on said spool member adjacent to said blocking ring member adapted so that if said spool is moved toward said relief port opening means, it raises said opening means out of said cylindrical bore thereby allowing the entry of fluids therethrough;

a series of pressurizing ports defined in said valve housing disposed radially in a plane transverse to the axis of, and communicating into said cylindrical bore;

pressurizing port check means associated with each of said pressurizing ports being normally biased closed, but adapted to be opened, said pressurizing ports adapted to be operated when said spool member is moved so that said blocking ring member is moved against said valve housing preventing the flow of hydraulic fluid from said inlet port to said tank outlet, and said feed slot is aligned with a selected pressurizing port thereby causing the hydraulic pressure within the cylindrical bore to escape through said pressurizing port as said fluid's pressure against said pressurizing port check means opens said pressurizing port check means allowing escape of said fluid through said pressurizing port;

a channel connecting each selected pressurizing port to an associated relief port; and an operation outlet port communicating with each of said pressurizing ports for connecting with a device to be operated by said valve.

4. The valve of claims 2 or 3 further including sealing means positioned toward each end of said spool member adapted to seal said spool within said cylindrical bore in a fluid-tight relation.

5. The valve of claim 4 further including stop means adapted to limit the axial movement of said spool member.

6. The valve of claim 2 or 3 further including means to balance pressure around said spool member.

7. The valve of claim 6 wherein said means for balancing pressure comprises a pressurizing port balance aperture defined within said valve housing opposite each of said pressurizing ports, and a balance slot defined within said spool opposite said feed slot.

8. The valve of claims 2 or 3 further including a relief chamber defined within said valve housing in which said blocking ring spool projection can be moved axially.

* * * * *